US005167266A

United States Patent [19]

Diehl et al.

[11] Patent Number: 5,167,266

[45] Date of Patent: Dec. 1, 1992

[54] APPARATUS FOR FILLING CONTAINERS WITH LIQUID

[75] Inventors: Egbert Diehl, Hackenheim; Dieter R. Krulitsch, Bad Kreuznach, both of Fed. Rep. of Germany

[73] Assignee: Seitz Enzinger Noll Maschinenbau Aktiengesellschaft, Mannheim, Fed. Rep. of Germany

[21] Appl. No.: 692,360

[22] Filed: Apr. 16, 1991

[30] Foreign Application Priority Data

Apr. 28, 1990 [DE] Fed. Rep. of Germany ..... 4013736
Mar. 25, 1991 [DE] Fed. Rep. of Germany ..... 4109731

[51] Int. Cl.[5] ..... B65B 1/32

[52] U.S. Cl. ..... 141/97; 141/39; 141/63; 141/92; 141/48; 141/172; 141/150; 141/263; 141/275

[58] Field of Search ..... 141/39, 40, 63, 85, 141/92, 97, 172, 148–150, 263, 275–278, 382, 48; 53/425, 426, 86

[56] References Cited

U.S. PATENT DOCUMENTS

| | | | |
|---|---|---|---|
| 2,289,135 | 7/1942 | Lucas | 141/97 |
| 2,536,299 | 1/1951 | Martin | 141/275 |
| 3,393,491 | 7/1968 | Burton et al. | 141/85 X |
| 4,579,156 | 4/1986 | Graffin | 141/85 X |
| 5,031,673 | 7/1991 | Clusserath | 141/6 |

FOREIGN PATENT DOCUMENTS

| | | | |
|---|---|---|---|
| 0303135 | 8/1988 | European Pat. Off. . | |
| 0334288 | 3/1989 | European Pat. Off. . | |
| 583843 | 6/1971 | Fed. Rep. of Germany | 141/275 |
| 3809855 | 2/1989 | Fed. Rep. of Germany . | |
| 880538 | 11/1961 | France | 141/63 |
| 1423451 | 9/1989 | U.S.S.R. | 141/39 |
| 2218079 | 11/1989 | United Kingdom . . | |

*Primary Examiner*—Ernest G. Cusick
*Attorney, Agent, or Firm*—Robert W. Becker & Associates

[57] ABSTRACT

An apparatus for filling containers, especially bottles, with liquid material is provided. The apparatus has at least one filling element for dispensing the liquid material into a respective container in a controlled manner. A bell-shaped portion is provided for each filling element and has a chamber for completely accommodating a container during a filling process. The underside of the bell-shaped portion has an opening for the introduction and withdrawal of a container. The apparatus also has a support mechanism that forms a support surface for the container and is disposed below the filling element in the direction of a filling element axis. Via relative movement between the bell-shaped portion and the support mechanism in the filling element axis, the chamber at the opening of the bell-shaped portion can be closed and opened by the support mechanism. Provided on the bell-shaped portion as well as on the support mechanism are interlocking mechanisms so that when the chamber of the bell-shaped portion is closed by the support mechanism, the bell-shaped portion and the support mechanism are positively interlocked with one another at least relative to forces acting in the direction of the filling element axis.

32 Claims, 9 Drawing Sheets

APPARATUS FOR FILLING CONTAINERS WITH LIQUID

BACKGROUND OF THE INVENTION

The present invention relates to an apparatus for filling containers, especially bottles, with a liquid material, including: At least one filling element for dispensing the liquid material into a respective container in a controlled manner; a bell-shaped portion for each filling element, with the bell-shaped portions having a chamber for completely accommodating a respective container during a filling process, and with an underside of the bell-shaped container having an opening for the introduction and withdrawal of a respective container; bottle support means; and means, preferably in the form of a lifting mechanism, for effecting a relative movement between the bell-shaped portion and the bottle support means in the direction of an axis of the filling element.

An apparatus or bottle filling machine is known (DE-OS 38 09 855), for example for aseptically dispensing liquid material; the bottom ends of each of the filling elements of this known apparatus are provided with an open bell-shaped portion, which completely accommodates the bottle that is to be filled. The bottom end of the bell-shaped portion can be closed off by a bottle support means or bottle plate that supports the bottle and that can be raised and lowered via a lifting mechanism. The reason for closing off the bell-shaped portion is so that the bottle that is accommodated thereby and by the chamber thereof can be subjected to steam under pressure during the filling process in a sterilization phase that precedes the actual filling phase. The pressure in the respectively closed bell-shaped portion is absorbed by the upper part of the machine that carries the filling elements and by the lifting mechanism, which among other things implies a considerable additional stressing of the upper part of the machine as well as of the lifting mechanism, and hence above all also implies additional wear of the lifting mechanism.

It is therefore an object of the present invention to improve an apparatus of the aforementioned general type in such a way that while being subjected to little wear and while having an optimum manner of operation, in particular also avoids the additional stressing of the upper part of the machine and/or either lifting mechanisms that might be present or other means that are provided for generating the relative movement between the bell-shaped portion and the bottle support means.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1A:
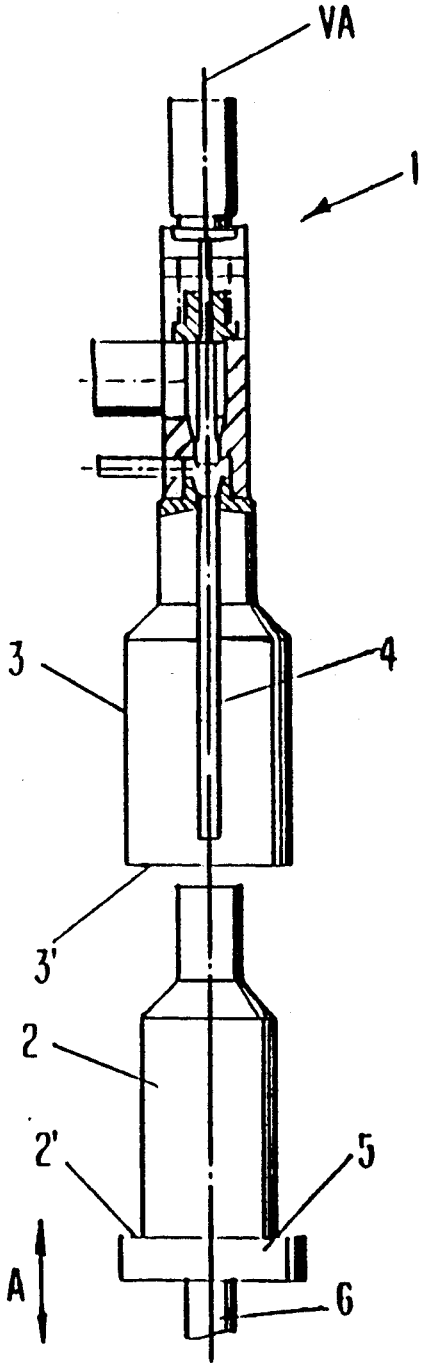
FIGS. 1*a* and 1*b* are very simplified views of one of the filling elements of a bottle filling machine, together with a bell-shaped portion provided on the filling element as well as a bottle plate which is provided below the filling element and the bell-shaped portion and on which is supported a bottle, whereby in FIG. 1*a* the bottle plate is lowered and in FIG. 1*b* the bottle plate is raised.

Where the apparatus also includes means for closing off the opening of the bell-shaped portion, the present invention is characterized primarily by interlocking means that are provided on the bell-shaped portion as well as on the means for closing off the opening thereof, so that when the chamber of the bell-shaped portion is closed off, the bell-shaped portion and the means for closing off the opening thereof are adapted to be positively interlocked with one another at least relative to forces acting in the direction of the axis of the filling element.

Where the bottle support means forms a support surface for the container and is disposed below the filling element, and where the relative movement between the bell-shaped portion and the bottle support means effects a closing and opening of the chamber of the bell-shaped portion at the opening thereof via the bottle support means, the present invention is characterized primarily in that sealing means are provided on one of the bell-shaped portion and the bottle support means, whereby when the chamber of the bell-shaped portion is closed off, the sealing means rest against a sealing surface of the other of the container support means and the bell-shaped portion, with this sealing surface being essentially disposed in a plane that extends perpendicular to the axis of the filling element.

Pursuant to a first specific embodiment of the present invention, the closed bell-shaped portion and the means for closing the same form a complete or self-contained system in the interlocking position of the interlocking means, even with respect to the forces generated by a pressure in the chamber. Thus, it is not necessary to transmit forces caused, for example, by the pressure in the chamber to external parts that carry the bell-shaped portion, the filling element, or the closure means. The entire machine can therefore have an appropriately light weight design, in particular with regard to construction, bearings, etc. The closure means is, for example, a cap that can be manually placed upon the respective bell-shaped portion, and/or the bottle support means that forms the support surface for the containers, whereby then via a relative movement between the bell-shaped portion and the bottle support means in the direction of the filling element axis the opening of the bell-shaped portion can be closed or opened.

A cap that can be manually placed into and removed from the bell-shaped portion is preferably used for closing the bell-shaped portion for cleaning purposes. The bottle support means serves for closing the bell-shaped portion during the various stages during filling of the container, for example during a sterilization with steam, a pressurizing with a pressurized gas, etc. Where the apparatus has a bottle support means for closing off the bell-shaped portion, the manually insertable and removable cap is preferably additionally provided for cleaning purposes. With an appropriate design of the means for the relative movement between the bell-shaped portion and the bottle support means, the latter can also be used for closing the bell-shaped portion during cleaning.

The control and/or actuation of the at least one interlocking means that is provided on the container support means and/or cooperates therewith is preferably effected either mechanically or via a fluid actuation, for example via compressed air, whereby pursuant to one basic possible specific embodiment, the control and/or actuation is effected by the stroke of the respective lifting mechanism. At least the movable interlocking means is then provided on that component (bell-shaped portion or bottle support means) that is moved up and down by the lifting mechanism.

Pursuant to another specific embodiment, the control and/or actuation of the at least one interlocking means that is provided on the bottle support means or cooperates therewith is effected with the use of control cam means that cooperate with stationary control elements past which the bottle support means move. For both of the aforementioned embodiments for the control and/or actuation of the at least one interlocking means, numerous variations are possible for the design of the interlocking means.

In order when the bell-shaped portion is closed to achieve a sealed closure between the bell-shaped portion and the closure means, in particular the bottle support means, a sealing means is provided that, to reduce the wear, i.e. to achieve a long service life, when the chamber or bell-shaped portion is closed, rests against a sealing surface on the bottle support means or the bell-shaped portion, with this sealing surface essentially being disposed in a plane that extends perpendicular to the filling element axis. As a result, frictional forces at the seal are largely avoided during closing and opening of the bell-shaped portion. The sealing means preferably has at least one sealing lip that rests against the sealing surface, and in particular preferably with a contact pressure that is generated by the pressure in the interior of the bell-shaped portion.

The inventive apparatus, which is preferably embodied as a filling machine having a plurality of filling elements, each of which is provided with a bell-shaped portion and a bottle support means, is suitable not only for the aforementioned aseptic dispensing, but rather in particular also for other processes where a closed chamber that can preferably be pressurized is required or at least expedient during the process.

Further specific features of the present invention will be described in detail subsequently.

DESCRIPTION OF PREFERRED EMBODIMENTS

Figure 1B:
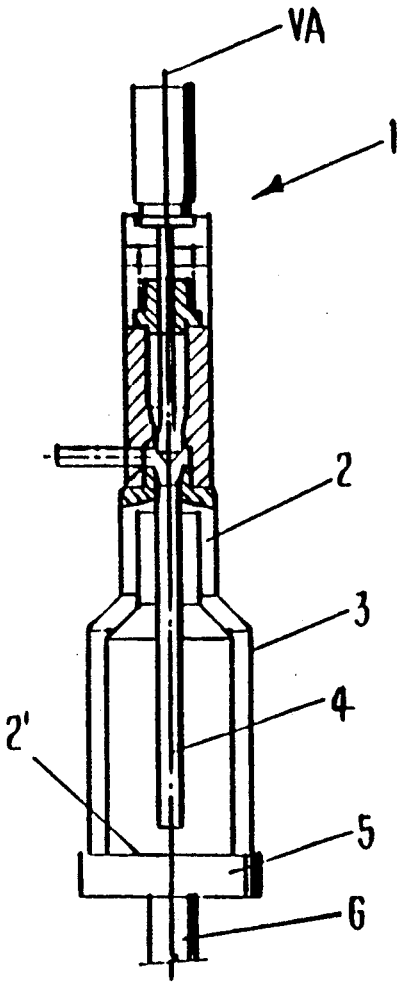

Referring now to the drawings in detail, shown is a filling element 1 that, together with a plurality of identical filling elements, is provided in the conventional manner about the periphery of a portion (rotor) of a bottle filling machine, which portion rotates about a vertical axis of the machine; the filling element 1 serves for filling bottles 2 with a liquid material (for example non-carbonated or carbonated beverages). Each filling element 1 has a conventional configuration and is provided with a bell-shaped portion 3 that is open at the bottom. The central axis of the bell-shaped portion 3 is vertically disposed and is coaxial with a filling element axis VA. In the illustrated embodiment, the bell-shaped portion 3 surrounds the entire length of a filling tube 4 of the filling element 1. As shown in FIG. 1*b*, the bell-shaped portion 3 can completely accommodate a respective bottle 2 that is to be filled. In a conventional manner, the base 2' of the bottle 2 rests upon a bottle supporting means that is provided below the filling element 1. The bottle supporting means is formed by a bottle plate 5, which can be raised and lowered in a vertical direction (see the double arrow A) via an only schematically indicated lifting mechanism 6 in such a way that at both the bottle inlet means and the bottle outlet means of the bottle filling machine the bottles 2 can respectively be placed upon or withdrawn from a bottle plate 5 without any interference from the filling element 1 or the bell-shaped portion 3. In at least one angular range of the rotational movement of the rotor of the bottle filling machine, the respective bottle plate 5 with an associated bottle 2 is raised to such an extent that it acts as a closure means and closes off the bottom opening or associated rim portion 3' of the bell-shaped portion 3, so that the respective bottle 2 is accommodated in a closed chamber, which can be necessary for various stages during a filling process, for example for sterilization with steam, for a pressurizing via a pressurized gas, etc. Since at the rim portion 3' the bell-shaped portion 3 has a relatively large inner diameter, when the interior of the closed bell-shaped portion 3 is subjected to steam or gas pressure, relatively large forces become effective that tend to move the bell-shaped portion 3 and the bottle plate 5 apart; these forces must be absorbed by the lifting mechanism 6 for the bottle plate 5 and/or by the filling element 1 or the support means therefor. In order to obtain relief for this situation, an interlocking means is provided via which, when the bottle plate 5 rests against the underside of the bell-shaped portion 3, the bell-shaped portion 3 and the bottle plate 5 are positively interlocked, as will be subsequently described in detail in conjunction with the various embodiments illustrated in FIGS. 2 to 12. These embodiments essentially differ only in the configuration of the bottle plate, which is provided with the interlocking means and is indicated by the reference numerals 5*a* to 5*g* in FIGS. 2 to 12, and with respect to the rim portions of the bell-shaped portion 3, which are indicated by the reference numerals 3*a'* to 3*g'* in FIGS. 2 to 12 and have a configuration that is adapted to the respective bottle plate.

Figure 2:
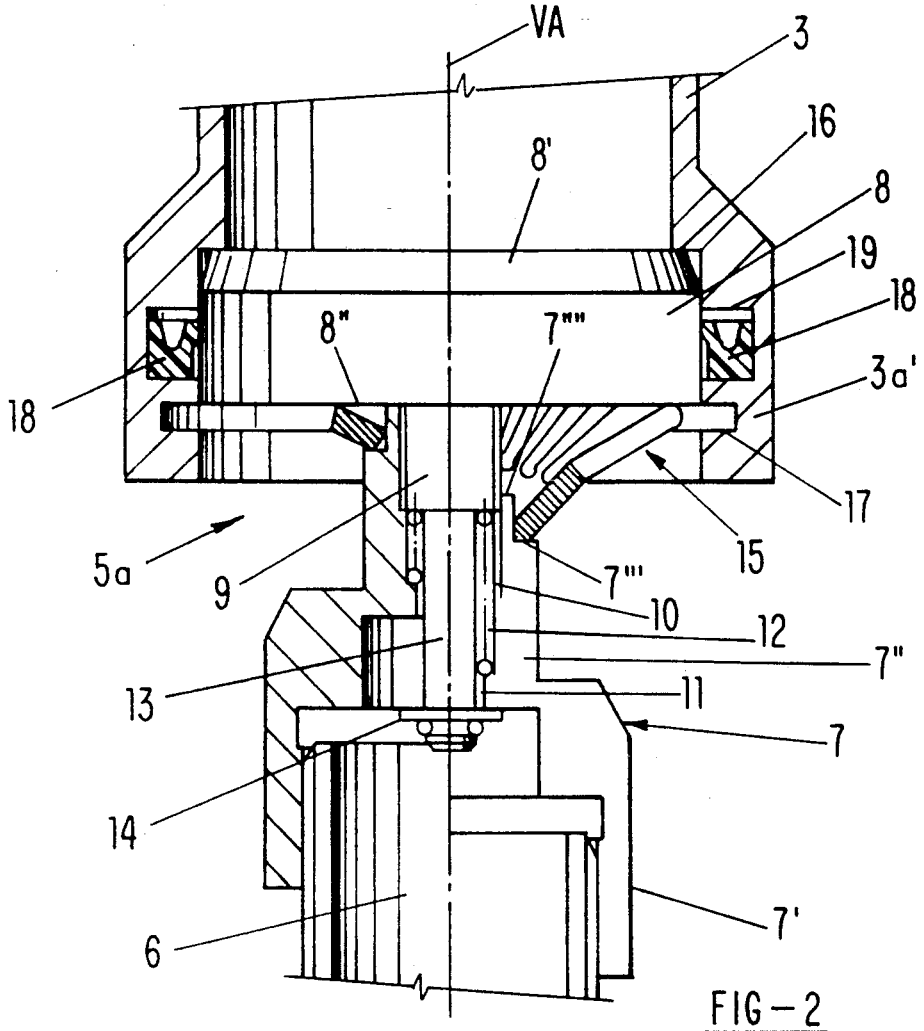
FIG. 2 is a partially cross-sectioned view of part of the bell-shaped portion as well as the bottle plate of a first exemplary embodiment of the present invention.
Figure 3:
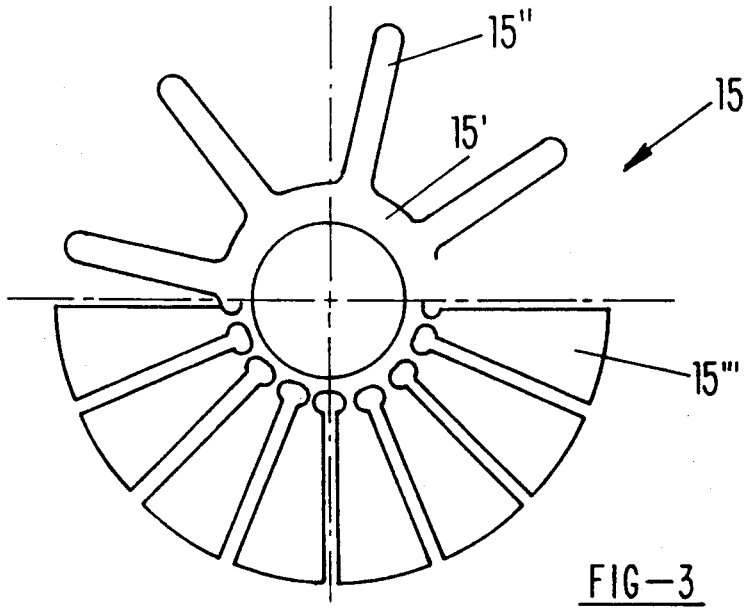
FIG. 3 is a plan view of an interlocking element for use with the embodiment of FIG. 2.

In the embodiment illustrated in FIGS. 2 and 3, provided on the upper end of a lifting cylinder that forms the lifting mechanism 6 is a head 7 that via a sleeve-like portion 7' extends around the upper end of the lifting mechanism 6 and is secured thereto. Guided in a similarly sleeve-like portion 7'', which projects upwardly beyond the portion 7' and has a reduced outer and inner diameter, is a plate member 8, which forms the support surface 8' for the bottles 2, and the central axis of which is vertically disposed. The plate member 8 is displaceably guided in the sleeve-like portion 7'' in the direction of its central axis, i.e. the filling element axis VA, with the aid of a pin-like projection 9 that projects beyond the underside 8'' of the member 8 and extends into the interior of the sleeve-like portion 7''. A compression spring 12, which extends around an extension 13 of the projection 9, presses against both the underside of the projection 9 as well as against a collar 11 formed in the bore 10. The extension 13, which is coaxial with the axis VA and has a smaller outer diameter than does the projection 9, extends through an opening formed in the vicinity of the collar 11, with the bottom end of the extension 13 being provided with a stop means 14 that is protected against overload. When the compression spring 12 is completely relaxed, the stop means 14 rests against that side of the collar 11 that is remote from the spring. The stop means 14 comprises, for example, a disk that is held on the extension 13 by a spring ring or washer that gives during overload.

The actual interlocking means of the bottle plate 5*a* comprises a one-piece interlocking ring 15 that is made from flat spring steel material. On an inner ring-shaped or conical portion 15', the interlocking ring 15 is provided with a plurality of outwardly extending, finger-like or wing-like portions 15'' and/or 15''' The portions 15'' differ from the portions 15''' essentially only in that the portions 15'' have a finger-like configuration with a constant width, and the portions 15''' have a sector-like configuration with a width that increases in a radially outward direction. The interlocking ring 15 can either be provided separately with the portions 15'' and 15''', or can be provided with a combination thereof. Regardless of this aspect, the interlocking ring 15 is formed in such a way that it also widens in a funnel-like manner in the region of the portions 15'' and 15'''. An inner rim of the portion 15' that is not provided with the portions 15'' and/or 15''' rests against an annular step 7''' of the head 7 that is formed at the upper end of the portion 7''; here the inner rim of the portion 15' of the interlocking ring 15 surrounds a portion 7'''', which has a smaller outer diameter than does the portion 7''. The axis of the interlocking ring 15 is coaxial with the axis VA, and in particular in such a way that the free ends of the portions 15' and/or 15'' rest against the underside 8'' of the member 8 and in the vicinity of these free ends are spaced further from the axis VA than is the situation in the transition zone to the portion 15'.

The configuration of the underside of the bell-shaped portion 3 is such that during closing-off of the latter, the bottle plate 5*a*, i.e. the plate member 8, can move into the opening of the bell-shaped portion 3, so that the periphery of the plate member 8 is surrounded by the lower, thicker rim portion 3*a*', with an abutment being provided on the bell-shaped portion 3 to prevent the plate member 8 from moving further up or into the bell-shaped portion 3. The aforementioned abutment is formed by a shoulder 16.

The right hand portion of FIG. 2 shows an operating state where the plate member 8 has just moved into the bell-shaped portion 3. The compression spring 12 is still relaxed, and the longitudinal dimensions of the portions 15'' and 15''' form an acute angle with the axis VA. If the lifting mechanism 6 moves up further, the plate member 8, which rests against the shoulder 16, is no longer moved along; rather, accompanied by increasing tension of the compression spring 12, only the head 7 moves upwardly, with the plate member 8 remaining stationary, as a consequence of which, due to an elastic deformation of the material of the interlocking ring 15, the portions 15'' and/or 15''' are increasing spread radially outwardly until they are finally disposed in a plane that extends essentially perpendicular to the axis VA, with the free ends of these portions extending into an annular groove 17 provided on the inner surface of the rim portion 3*a*'. As a result, the bell-shaped portion 3 and the bottle plate 5*a* are positively interlocked in the manner illustrated in the left hand portion of FIG. 2. An absolutely tight sealing of the closed bell-shaped portion 3 is achieved via a sealing ring 18, which is provided in an annular slot 19 on the inner surface of the rim portion 3*a*' and rests against the peripheral surface of the plate member 8 when the latter is introduced into the bell-shaped portion 3. The sealing ring 18 has an essentially V-shaped cross-sectional configuration and is disposed in such a way that the open side of this V-shaped cross-sectional configuration faces the pressure-loaded side of the region that is to be sealed. This ensures a particularly effective and reliable seal.

Figure 4:
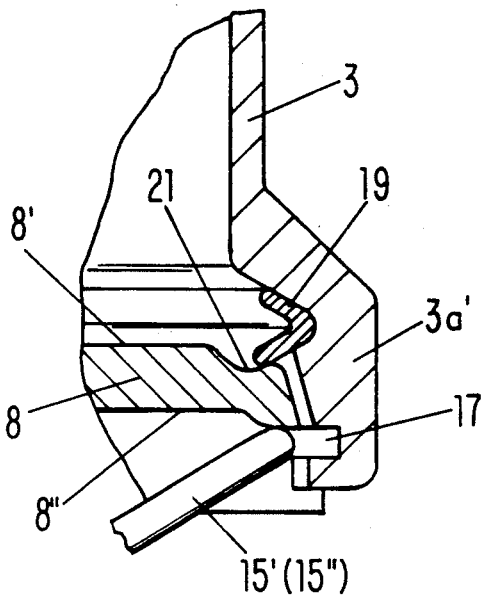
FIGS. 4 and 5 are cross-sectional views of part of the bell-shaped portion in the vicinity of its lower opening as well as of the bottle plate showing possible modifications of the embodiment of FIG. 2.
Figure 5:
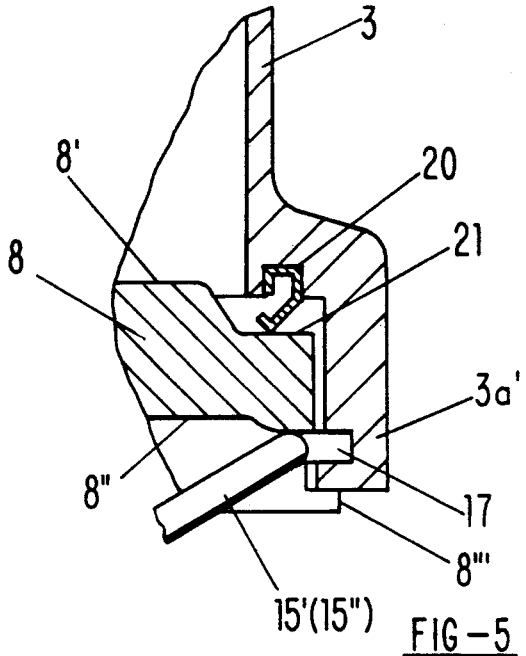

FIGS. 4 and 5 show two modified arrangements that differ from the embodiment of FIG. 2 essentially only in that in place of the sealing ring 18, a sealing ring 19 or 20 is used that again has a V-shaped cross-sectional configuration, although in this case the open side is directed radially inwardly; in addition, the upper side 8' of the plate member 8, in the vicinity of the rim thereof, is provided with a lower, annular sealing surface 21 against which a lip-like portion of the sealing ring 19 or 20 rests when the bell-shaped portion 3 is closed off. The advantage of the modified arrangement of FIGS. 4 and 5 over the embodiment of FIG. 2 is that during opening and closing of the bell-shaped portion 3, practically no friction occurs between the plate member 8 and the respective sealing member 19 or 20, i.e. the sealing rings 19 and 20 are thus subjected to considerably less wear than is the sealing ring 18. The sealing surface 21 is lower than the upper side or support surface 8' for the bottles 2, and is also lower than the glide plates or glide surfaces provided at the bottle inlet and bottle outlet, so that the sealing surface is also protected against wear and abrasion. At the bottle inlet as well as at the bottle outlet of the bottle filling machine, the sealing surface 21 is preferably covered by the glide plates located there. The modified arrangements shown in FIGS. 4 and 5 furthermore differ from the embodiment of FIG. 2 in that in place of the abutment or shoulder 16 that cooperates with the upper side 8', the plate member 8 is provided in the vicinity of its underside 8'' with a radially projecting flange or collar 8''' that rests against the underside of the rim portion 3*a*' when the bell-shaped portion 3 is closed. This makes it possible for the interior of the bell-shaped portion 3 to have smooth, easy to clean surfaces. The collar can also be cleaned without difficulty.

Figure 6:
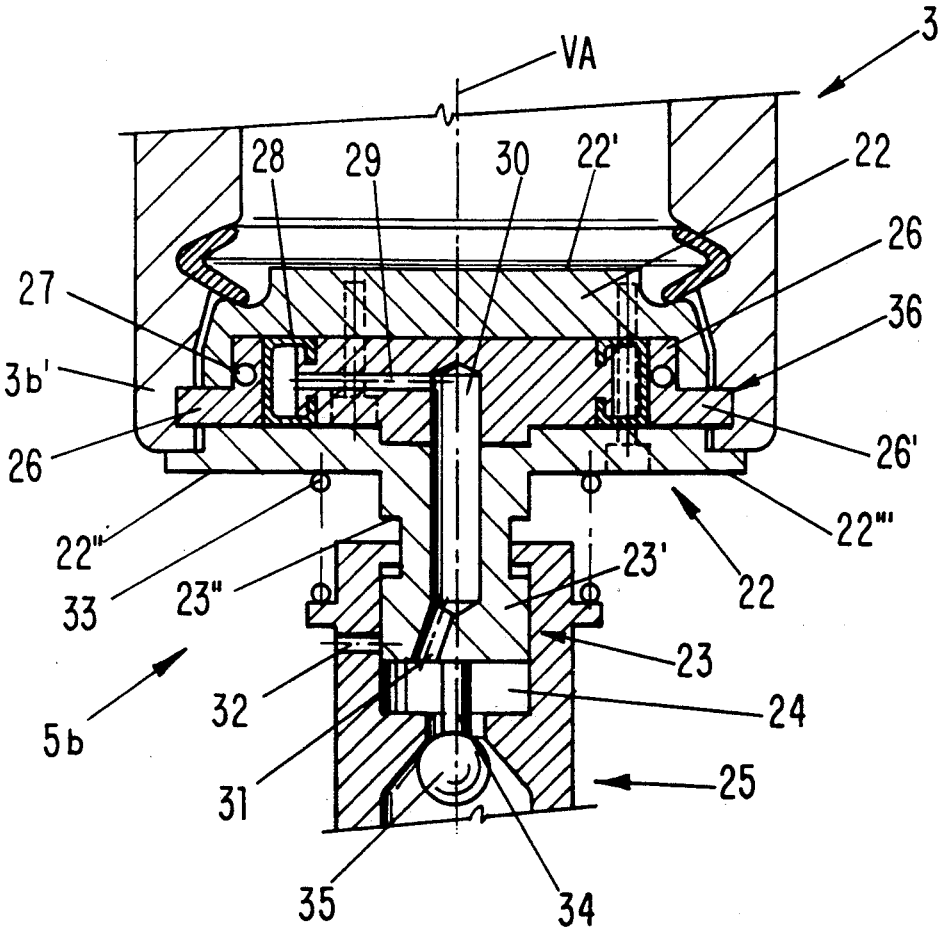
FIGS. 6 to 9 are views similar to that of FIG. 2 showing four further exemplary embodiments of the present invention.

FIG. 6 shows an embodiment that differs from the embodiment of FIG. 2 essentially in that the bottle plate 5*b* can be interlocked with the bell-shaped portion 3 in a pneumatic manner. The bottle plate 5*b* has a plate member 22, the basic function of which corresponds to that of the plate member 8. The upper side 22' of the plate member 22 again forms the support surface of the bottle plate 5*b*. The underside 22' is provided with a projection 23 that is coaxial with the axis VA, and that via a piston-like portion 23' is displaceably guided in the direction of the axis VA in a recessed portion 24 of a head 25, with this relative movement between the member 22 and the head 25 being limited to a maximum stroke via abutment means of the head 25 that engage in an annular groove 23'' of the projection 23.

Interlocking segments 26 are provided in the plate member 22 and are distributed at prescribed distances about the axis VA. The interlocking segments 26 are radially displaceable relative to the axis VA in such a way that in a first position a radially outwardly disposed portion 26' of the interlocking segments 26 is disposed within the periphery of the plate member 22, while in a second, interlocking position, the portions 26' of the interlocking segments 26 respectively extend beyond the peripheral surface of the plate member 22. In the illustrated embodiment, three interlocking segments 26 are provided. Via spring means, for example via a common helical spring 27, the interlocking segments 26 are preloaded in such a way that they are normally disposed in the non-interlocking position. By means of a pneumatic actuating mechanism, which in the illustrated embodiment is formed by a hose-like diaphragm 28, the interlocking segments 26 can be moved outwardly into the interlocking position against the effect of the helical spring 27 by supplying pressure to the interior of the diaphragm 28. By means of passages 29, 30 and 31, the interior of the diaphragm 28 communicates with a chamber formed by the recessed portion 24.

To close off the bell-shaped portion 3, the plate member 22 of the bottle plate 5*b* is first moved into the bell-shaped portion 3, whereby the interlocking segments 26 are in their disengaged position, and the chamber formed by the recessed portion 24 communicates with the atmosphere via an opening 32 that is provided in the head 25. When the plate member 22 has moved into the opening of the bell-shaped portion 3 to such an extent that this plate member is surrounded by the rim portion 3*b*', and a collar 22''' of the plate member rests against this rim portion, the head 25, accompanied by the tensioning of a compression spring 33, moves further upwardly while the plate member 22 remains stationary, as a result of which the portion 23' closes the opening 32 and, via a push rod 34 that extends from the portion 23', a valve 35 to a compressed air line is opened, so that via this valve 35 and the passages 29–31, compressed air can flow into the interior of the diaphragm 28, as a result of which the interlocking segments 26 are moved radially outwardly into their interlocking position in which the interlocking portions 26' thereof engage in an annular groove 36 that is provided on the inner surface of the rim portion 3*b*'. The disengagement is automatically effected in that during a downward movement of the head 25, the valve 35 is closed and at the same time the opening 32 is released by the portion 23', so that upon the removal of air from the interior of the diaphragm 28, the interlocking segments 26 return to their non-interlocking position.

Figure 7:
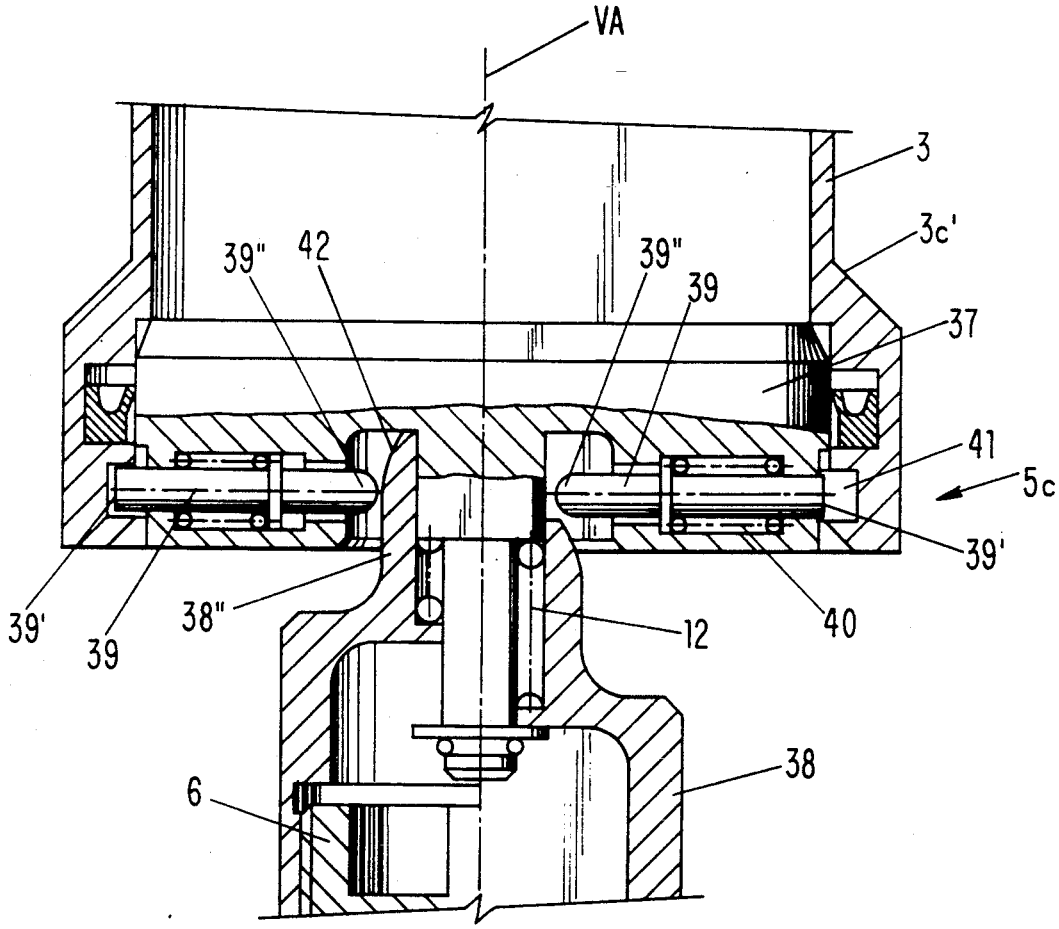

Instead of a pneumatic actuation of the interlocking segments, a mechanical actuation is also conceivable. Such an embodiment is shown in FIG. 7. In this embodiment, the bottle plate 5*c* comprises a plate member 37, which corresponds to the plate member 8, and which at a head 38 provided on the lifting mechanism 6 can be shifted in the direction of the axis VA by a prescribed amount or stroke against a spring action, namely against the effect of the compression spring 12. The configuration of the head 38 corresponds largely to that of the head 7. With regard to the guidance of the plate member 37 on the head 38, the bottle plate 5*c* is practically identical to the bottle plate 5*a*. The essential difference to the bottle plate 5*a* is that the bottle plate 5*c*, as interlocking elements, is provided with a plurality, for example at least three, interlocking pins 39 that are disposed in the vicinity of the underside of the plate member 37 and can be shifted in the plate member radially relative to the axis VA, and in particular in such a way that in a non-interlocking position, the radially outwardly disposed ends or portions 39' of these interlocking pins 39 are disposed within the circumferential line of the plate member 37 and can be moved radially outwardly out of this position against the effect of respective return springs 40, so that the ends 39' engage in a recess or groove 41 that is provided on the inner surface of the rim portion 3*c*' of the bell-shaped portion 3. Actuation of the interlocking pins 39 is effected via a wedge or cone surface 42 that is provided on the outer surface of the sleeve-like portion 38'', which corresponds to the portion 7'', and in particular in the vicinity of the upper end of this portion, in such a way that when the plate member 37 is introduced completely into the bell-shaped portion 3 and is held securely in place thereby, and when the head 38 moves further upwardly, the radially inwardly disposed ends 39'' of the interlocking pins 39 come to rest against the cone surfaces 42, as a result of which the interlocking pins 39 are increasingly moved outwardly.

In place of the interlocking pins 39, it would also be possible to use other interlocking elements that can be moved radially outwardly via the head or via a control surface (wedge or cone surface) located there. As shown in the bottle plate 5*d* of FIG. 8, an example of such an interlocking element is a split ring 46, which is made of spring wire. The bottle plate 5*d* essentially comprises the plate member 43 and the head 44, which corresponds to the head 38. The outer surface of the upper end of the head 44 is provided with a conical surface 45 in such a way that in the vicinity of this conical surface, the head 44 is tapered toward the upper end. Seated on the conical surface 45 is the split ring 46, which essentially concentrically surrounds the axis VA. Above the ring 46, the plate member 43 forms an annular surface 47 that similarly concentrically surrounds the axis VA, and is essentially disposed in a plane that extends perpendicular to this axis. If the plate member 43, which is guided on the head 44 in the same manner as the plate member 8 is guided on the head 7, is introduced into the open end of the bell-shaped portion 3 in such a way that the plate member 43, which is surrounded by the rim portion 3*d*', cannot move upwardly any further, then when the head 44 moves further upwardly, the ring 46 is increasingly spread apart radially relative to the axis VA via the conical surface 45 and finally, before the upper end of the head 44 comes to rest against the plate member 43, is partially disposed in a groove 48 that is provided on the inner surface of the rim portion 3*d*', and in particular in such a way that the annular abutment surface 47, which directly adjoins the peripheral surface of the plate member 43, can be supported against the upper portion of the ring 46, and the lower portion of the ring 46 is supported on a pertaining edge of the groove 48. The thus spread-apart ring 46 then prevents the bell-shaped portion 3 and the plate member 43, i.e. the bottle plate 5*d*, from moving apart, as illustrated in the left hand portion of FIG. 8.

Figure 8:
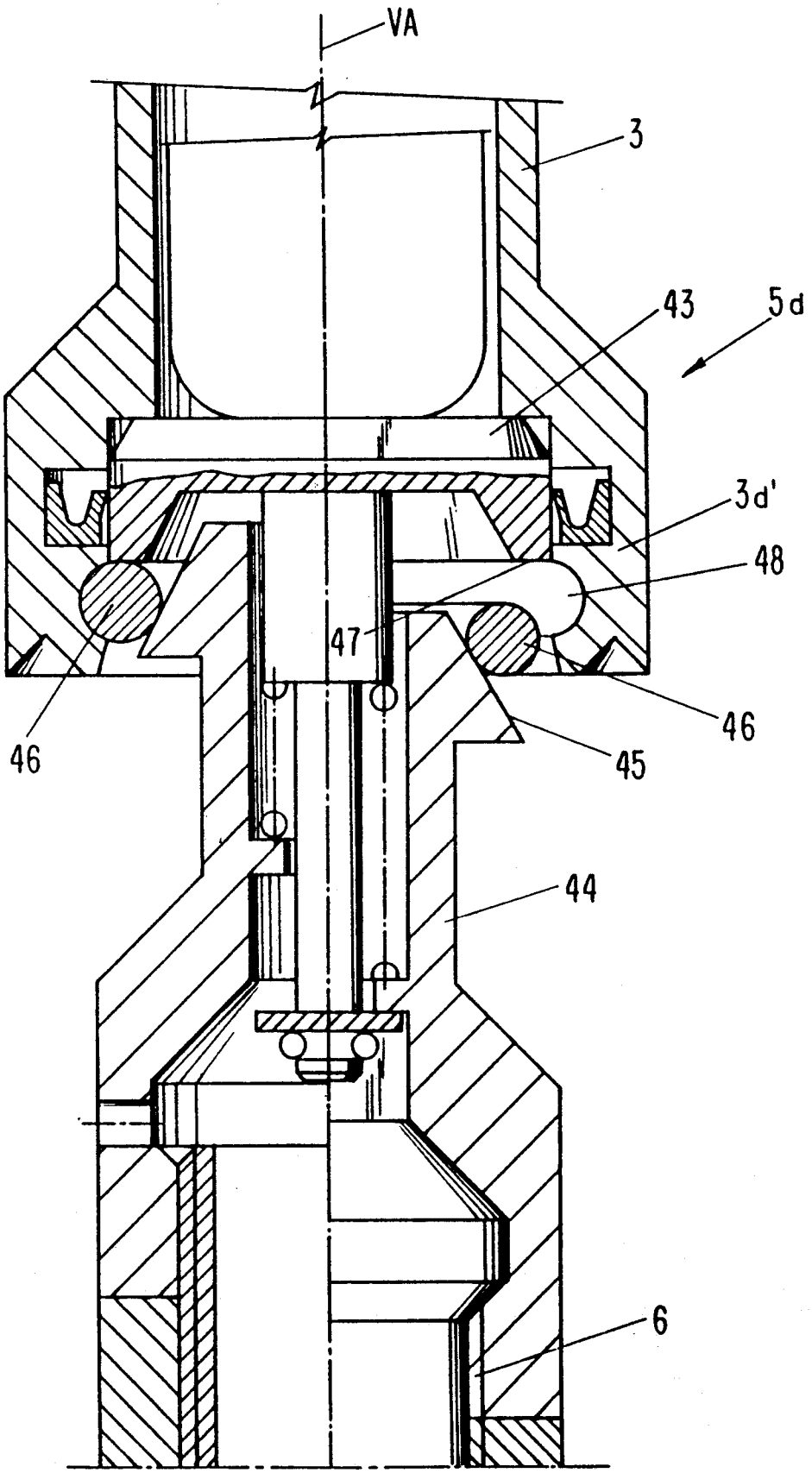

It is to be understood that in the non-expanded state, the ring 46 does not extend beyond the peripheral surface of the plate member 43, as illustrated in the right hand portion of FIG. 8, so that in order to close the bell-shaped portion 3 (with the ring 46 not spread or expanded), the plate member 43 can be introduced into, and for the reopening of the bell-shaped portion 3 (with the ring 46 no longer expanded), the plate member 43 can be withdrawn from the bell-shaped portion.

Figure 9:
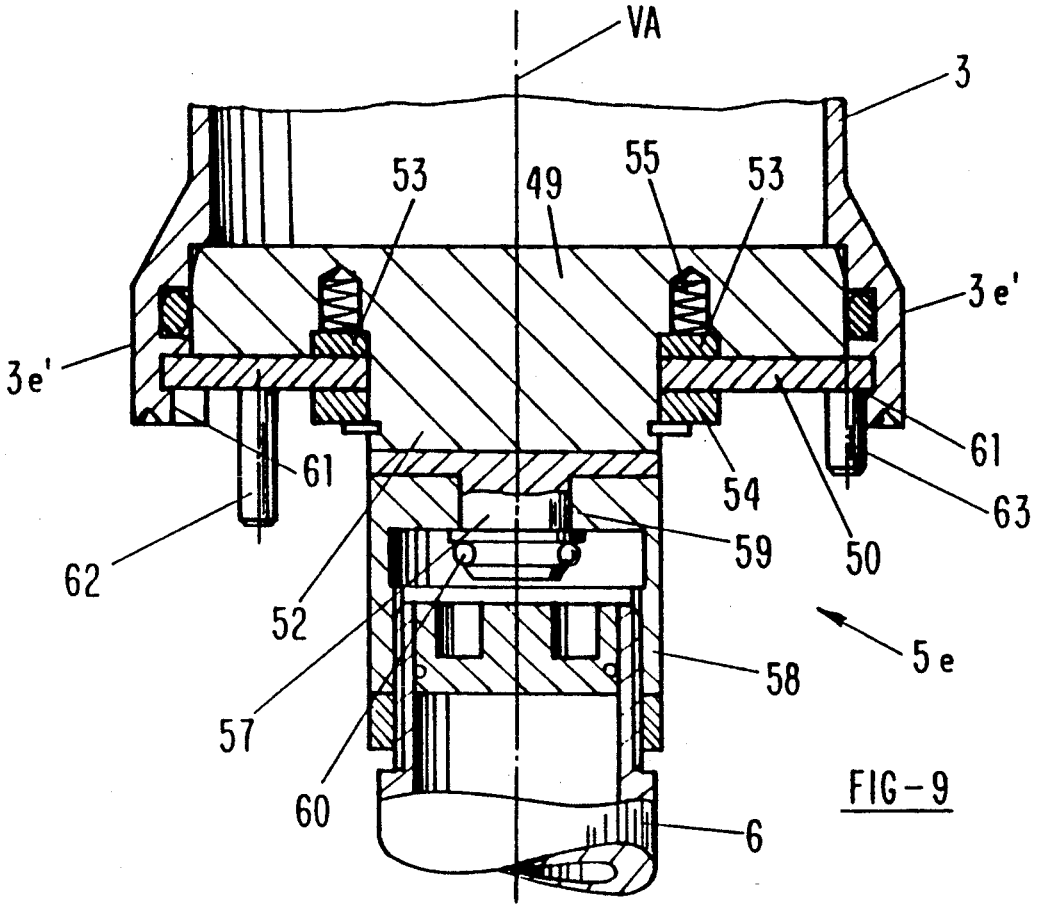
Figure 10:
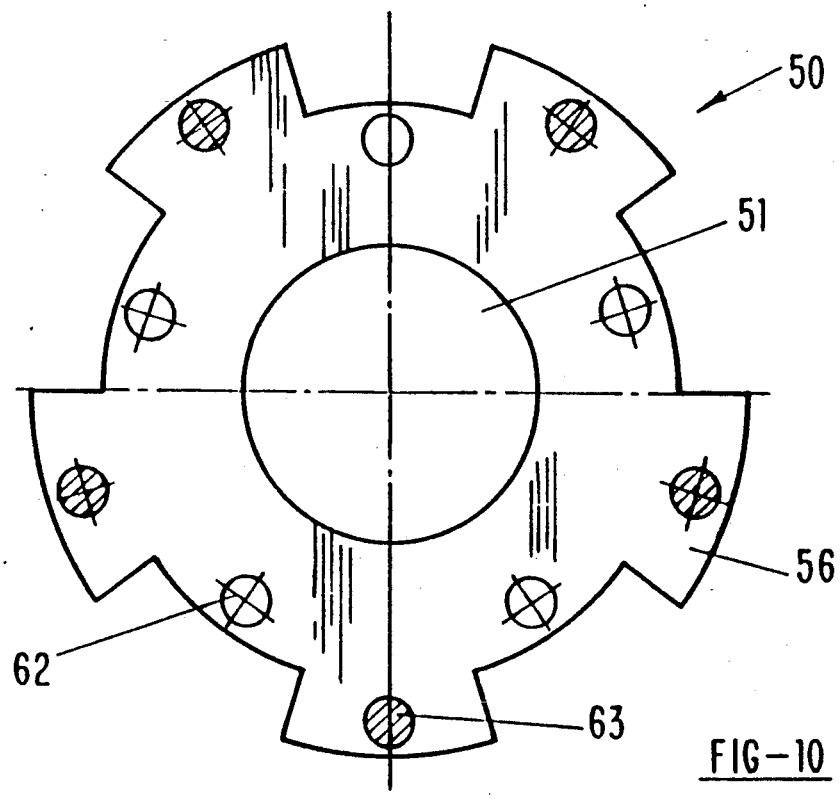
FIG. 10 is a plan view of an interlocking disk for use with the embodiment of FIG. 9.

As a further possible embodiment, FIGS. 9 and 10 show a bottle plate 5*e* where the interlocking of the bell-shaped portion 3 with the bottle plate, i.e. the plate member 49, is effected via an interlocking disk 50 that is provided on the underside of the plate member 49 in such a way as to be freely rotatable about the axis VA. The interlocking disk 50 is provided with a central opening 51 via which the disk is mounted on a circular cylindrical projection 52 that extends beyond the underside of the plate member 49, whereby the disk is freely rotatable about the axis VA. In particular, the interlocking disk 50 is mounted between two rings 53 and 54, with the bottom ring 54 being secured so that it cannot shift axially, and with the upper ring 53 being subjected to the effect of several compression springs 55, so that at the rim of the opening 51, the interlocking disk 50 is clamped between the rings 53 and 54 by the force of the compression springs 55 and can accordingly be rotated about the axis VA only when a torque that is determined by this clamping tension is overcome. Disposed on the outer periphery of the interlocking disk 50 are a plurality of interlocking segments 56 that also extend radially beyond the peripheral surface of the plate member 49, whereas the rest of the interlocking disk 50 does not extend beyond this peripheral surface. By means of an extension 57 that projects beyond the bottom end of the projection 52, the plate member 49 is secured to a head 58 that is provided on the lifting mechanism 6. In this connection, the head 58 is embodied as a threaded sleeve that is screwed onto the upper end of the lifting mechanism 6, with that end that extends beyond the lifting mechanism being closed off by a base portion. The extension 57 extends through an opening 59 of this base portion and is secured or held in the head 58 with overload protection via a stop means 60 that corresponds to the stop means 14.

The rim portion 3*e*' of the bell-shaped portion 3 is embodied in such a way that in order to close the bell-shaped portion 3, the plate member 49, together with the interlocking disk 50, can be introduced into the bell-shaped portion, whereupon both components are then surrounded by the rim portion 3*e*'. Provided on the inner surface of the rim portion 3*e*' are shoulder means 61 that are coordinated with the interlocking segments 56. In particular, the shoulder means 61 are disposed about the axis VA in conformity with the distribution of the interlocking segments 56 in such a way that in those angular positions of the interlocking disk 50 that correspond to a non-interlocking position, all of the shoulder means 61 are disposed in the areas between the interlocking segments 56. By turning the interlocking disk 50 by an amount that corresponds to half of the spacing or angular distance between two interlocking segments 56, the interlocking disk 50 assumes the interlocking position, in which the interlocking segments 56 extend into the shoulder means 61, as a consequence of which the bell-shaped portion 3 and the bottle plate 3*e* are positively interconnected. The left hand portion of FIG. 9 shows the non-interlocking position of the interlocking disk 50, and the right hand portion shows the interlocking position.

The control of the interlocking disk 50, in other words the stepwise advancement of this disk by half of the spacing, for interlocking and disengagement, is effected via external, stationary control elements, i.e. elements that are not moved along with the rotor of the filling machine, that cooperate with pin-like control cams or dogs 62 and 63. The axes of these dogs or projections 62, 63 are disposed parallel to the axis VA and are provided on the interlocking disk 50 in such a way that they project beyond the underside thereof. Each control dog 62 is disposed on the outer periphery of the interlocking disk 50 in the area between two successive interlocking segments 56. The control dogs 63, which are shorter than the dogs 62, are respectively provided in the region of an interlocking segment 56, and in particular are disposed somewhat more radially outwardly from the central axis VA than are the control dogs 62.

As a result of the different lengths and the different radial spacings of the control dogs 62 and 63, it is possible to provide respectively separate, stationary control elements for the control dogs 62 and for the control dogs 63, in order in this way for each interlocking disk 50 to ensure the correct position as a function of the respective angular position of the rotor of the bottle filling machine.

Figure 11:
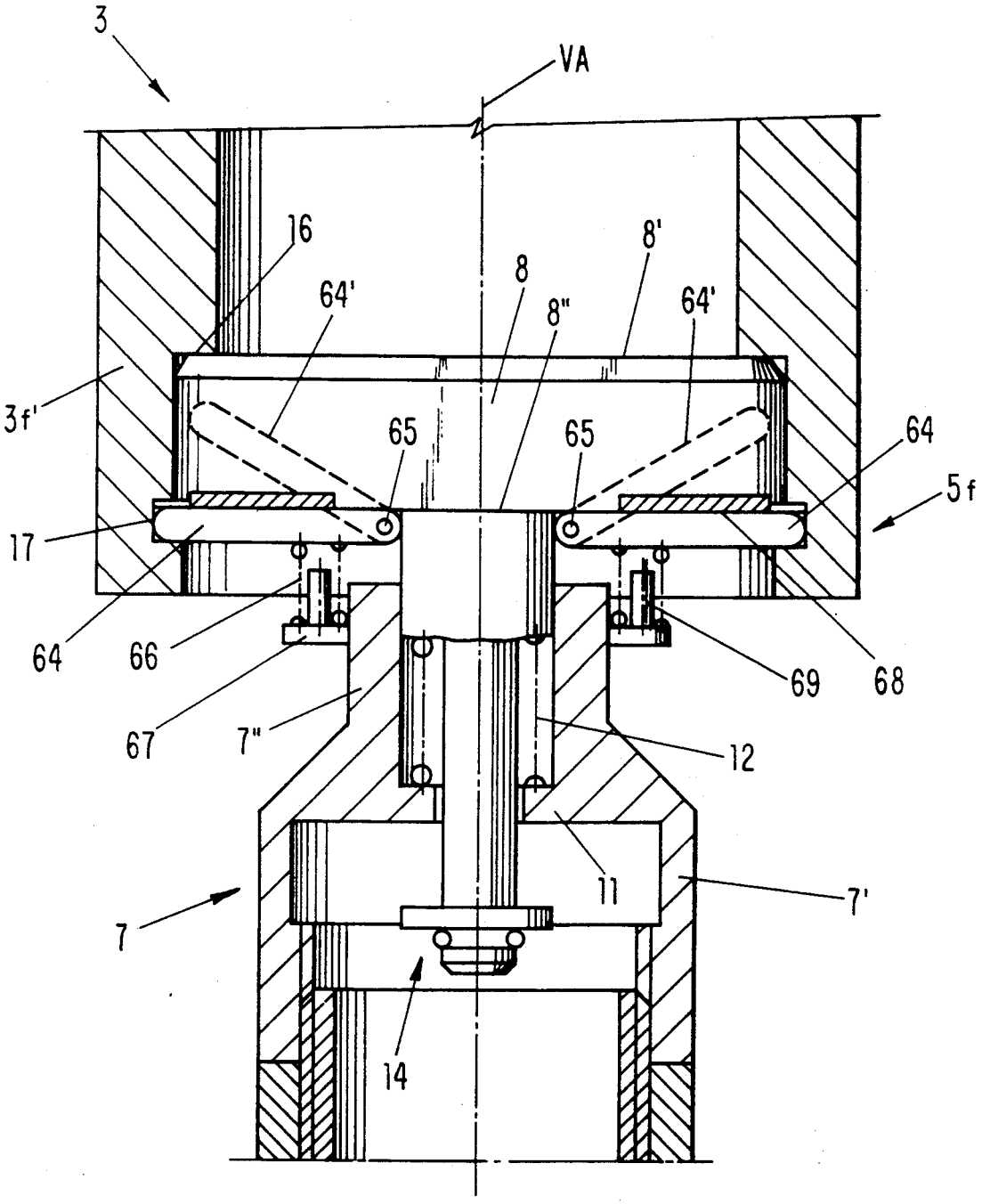
FIGS. 11 and 12 are views similar to FIG. 2 showing two preferred exemplary embodiments of the present invention.

As a further specific embodiment, FIG. 11 shows a bottle plate 5*f* that is a preferred modification of the bottle plate 5*a* and differs therefrom merely in that instead of the interlocking ring 15 with the portions 15'' or 15''', a plurality of levers 64 are provided. In other respects, the bottle plate 5*f* corresponds in construction and configuration to the bottle plate 5*a*, so that in FIG. 11 elements that basically correspond in form and function to those of the bottle plate 5*a* have the same reference numerals as in FIG. 2. The levers 64, with, for example, three or four being equidistantly distributed about the axis VA, are mounted at one end to the upper end of the portion 7'' of the head 7 via respective pivot pins 65 in such a way that the levers 64 are pivotable about the axis of the respective pivot pins. The axis of all of the pivot pins 65 are disposed in a common plane that extends perpendicular to the filling element axis VA and form the tangents to a common imaginary circle that surrounds this axis VA. A common compression spring 66 can be provided that surrounds the upper end of the portion 7'', with the upper end of the compression spring 66 being supported against the lever 64, and with the bottom end of the spring 66 being supported against a collar 67 that projects beyond the outer surface of the portion 7''. Via this compression spring 66, the levers 64 are preloaded in their non-interlocking position, which is respectively indicated in FIG. 11 with the dot-dash lines 64'; in this non-interlocking position, the levers 64, i.e. their longitudinal dimensions, which respectively extend perpendicular to the axis of the pertaining pivot pin 65, form with the axis VA an acute angle that opens in an upward direction, with the free end of each lever 64 resting against the underside 8'' of the plate member 8, i.e. against a gliding surface 68 provided there, at a radial distance from the axis VA that is greater than the radial distance of the pertaining pivot pin 65 from this axis. Again with this embodiment the annular groove 17 is provided on the inner side of the rim portion 3*f*' of the bell-shaped portion 3, and in particular in such a way that in the embodiment shown in FIG. 11 the upper horizontal side or confining surface of the groove 17 is essentially disposed in the same plane as the underside 8" of the plate member 8 when the latter, after introduction into the bell-shaped portion 3, comes to rest against the shoulder 16 or some other abutment. When the head 7 is moved further upwardly relative to the plate member 8, the levers or arms 64 are then pivoted downwardly against the effect of the compression spring 66, so that the longitudinal dimensions of these arms are finally disposed essentially radially relative to the axis VA and the radially outer ends of the levers engage in the groove 17, thereby interlocking the bottle plate 5*f* with the bell-shaped portion 3 in the manner illustrated in FIG. 11.

In place of a common compression spring 66, it would also be possible to provide a separate compression spring for each lever 64, with respective pins 69 then being provided on the collar 67 to secure these springs.

Figure 12:
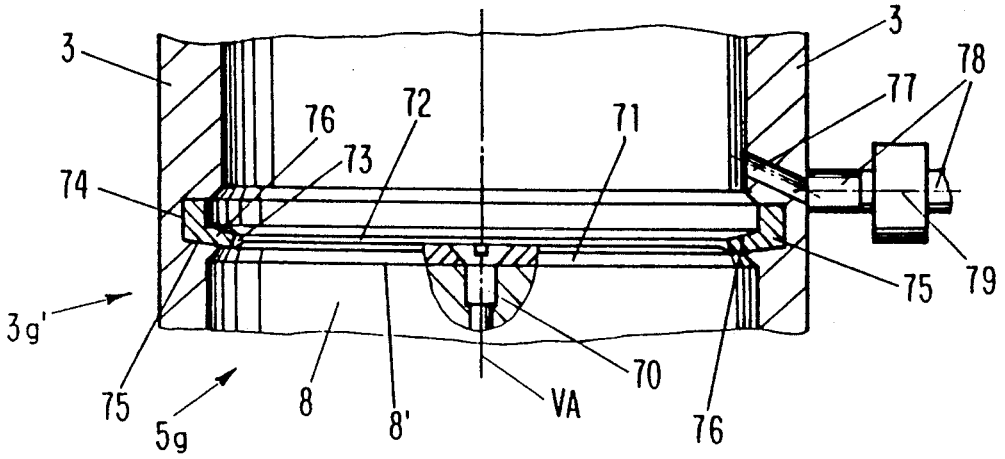

FIG. 12 shows a further embodiment of a bottle plate 5*g* that is a modification of the bottle plate 5*f* and, among other things, differs therefrom in that a plate 71 is secured to the upper side 8' of the plate member 8 via a screw 70; this plate 71, as an interchangeable closure member or means, forms the support surface 72 for the bottles 2 that are to be filled. The periphery of the circular disk-shaped plate 71 is provided with an annular recessed portion that is open not only toward the periphery of the plate but also toward the upper side of the plate; this recessed portion forms a sealing surface 73 that is disposed lower than the support surface 72 and hence corresponds to the sealing surfaces 71 of the embodiments of FIGS. 4–6. The support surface 72 of the plate 71 is preferably provided with centering means for the bottles 2. This centering means is formed, for example, from non-illustrated centering projections, from semi-circular elements, etc. Via such centering means, even with narrow-necked bottles 2 an exact positioning is insured relative to the axis VA, and a respective filling tube 4 is prevented from striking the mouth of a narrow-neck bottle 2 as the latter is raised.

In this embodiment, the bell-shaped portion 3 has a rim portion 3*g*' that essentially corresponds to the rim portion 3*f*'. The interlocking of the bottle plate 5*g* with the bell-shaped portion 3 is also effected in the same manner as was described in conjunction with the bottle plate 5*f*. However, in the interior of the bell-shaped portion 3 there is provided in the rim region 3*g*' a radially inwardly open groove 74 that extends concentrically about the axis VA and in which is disposed an angular seal 75 that in the vicinity of its lower edge, as shown in FIG. 12, is provided with an annular sealing lip 76 that projects radially inwardly; when the bottle plate 5*g* closes off the bell-shaped portion 3, the sealing lip 76 rests from above against the annular sealing surface 73 of the plate 71. When a pressure exists within the bell-shaped portion 3, the sealing lip 76 is pressed against the sealing surface 73, thus reliably sealing the transition between the bell-shaped portion 3 and the bottle plate 5*g*. As was the case with the seals 19 and 20, the seal 75 is also subjected to only extremely little wear.

Provided in the rim portion 3*g*' is a passage 77 that opens out in the interior of the bell-shaped portion 3 directly above the annular seal 75, whereby when the bell-shaped portion 3 is closed, the opening of the passage 77 is spaced slightly above the support surface 72. At the outside of the bell-shaped portion 3, the passage 77 is connected to a channel, i.e. with a conduit 78, that leads to a valve arrangement 79 that is disposed on the bell-shaped portion 3 and is illustrated only schematically in FIG. 12.

The low arrangement of the passage 77, i.e. the arrangement of this passage directly above the annular seal 75, has the advantage, for example during a treatment with steam or with the discharge of steam via this passage, that steam can flow about the entire height of a bottle 2 from the top to the bottom.

Figure 13:
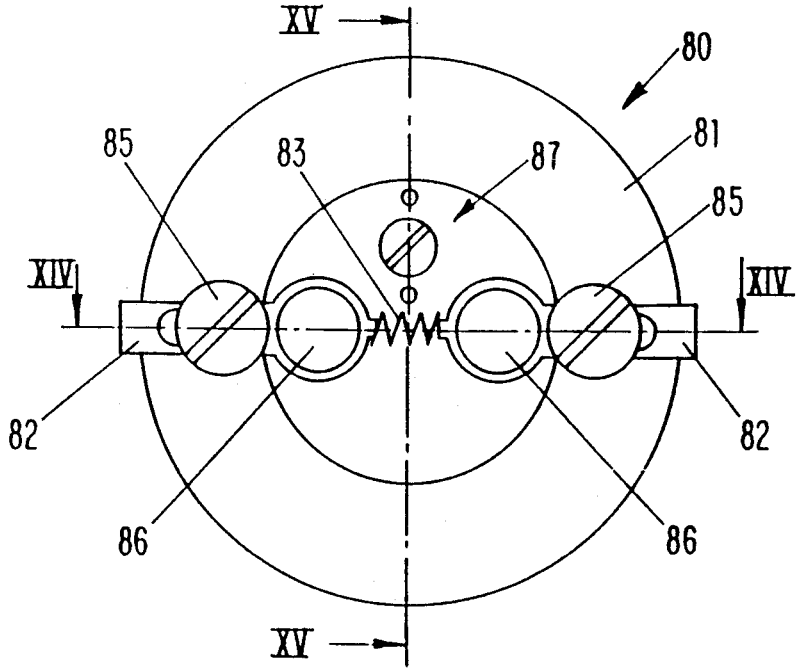
FIG. 13 is a bottom view of a cap for closing off the bell-shaped portion.
Figure 14:
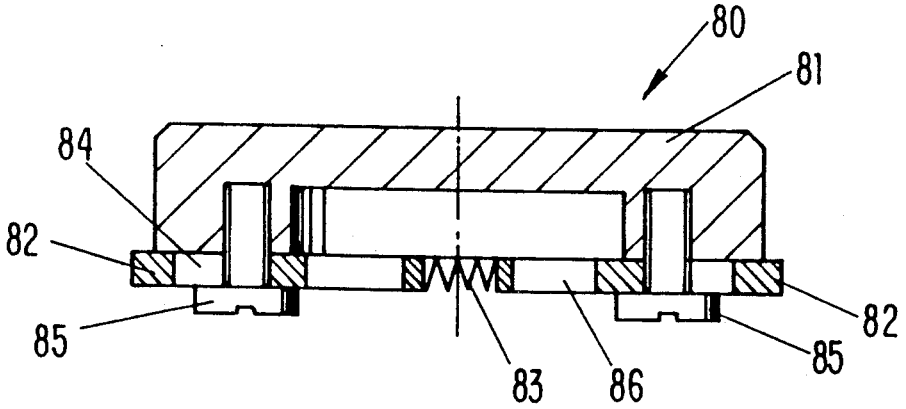
FIG. 14 is a cross-sectional view taken along the line XIV—XIV in FIG. 13.
Figure 15:
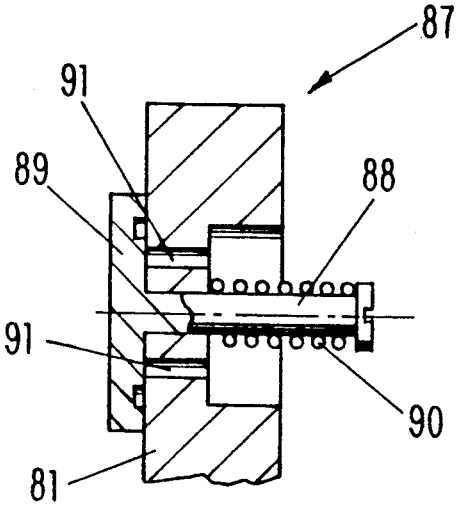
FIG. 15 is a cross-sectional view taken along the line XV—XV in FIG. 13.
Figure 16:
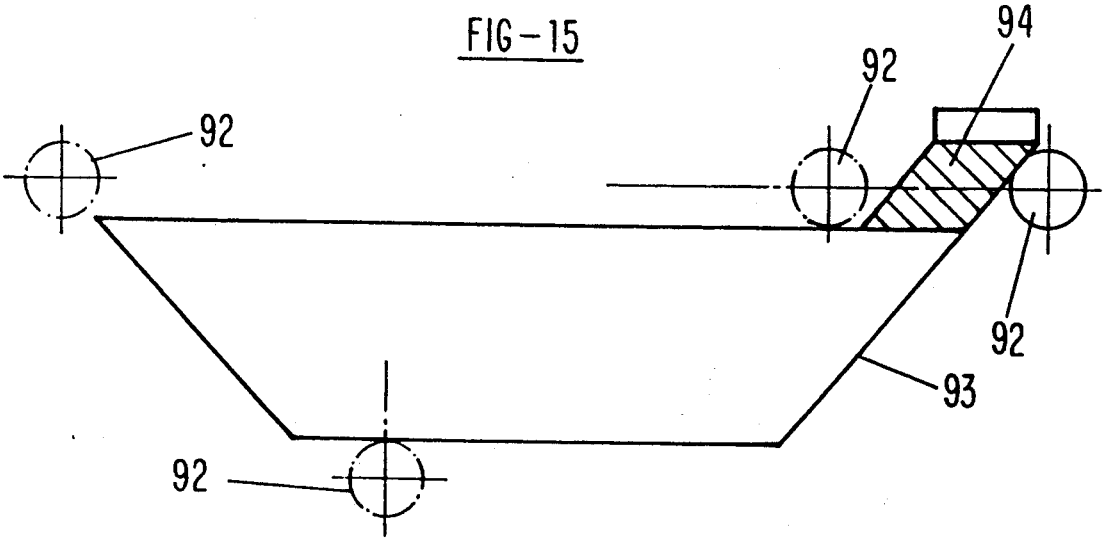
FIG. 16 is a simplified view of a stationary lifting cam for the lifting means of a bottle filling machine.

FIGS. 13 and 14 show a closure cap 80 that acts as a closure means for closing off the bottom end of the bell-shaped portion 3, and in particular when a cleaning of the bottle filling machine with liquid cleaning medium is to be effected in a closed cycle. The cap 80 essentially comprises a plate member 81 that fits into the bottom, open end of the respective bell-shaped portion 3 and after insertion into this open end closes off the bell-shaped portion; in other words, the plate member 81 has a similar configuration to that of the plate member 8. On its underside, the plate member 81 is provided with two interlocking elements 82 that relative to the central axis of the plate member 81 can be shifted radially and are preloaded radially outwardly by a compression spring 83. In the illustrated embodiment, the interlocking elements 82 are stamped parts that are made from flat material. To make the radial displacement possible, each interlocking element 82 is provided with a slot 84 through which a screw 85 extends to hold the interlocking element 82 to the underside of the plate member 81. The interlocking elements 82 are at the same time pivotable about the screws 85. The radially inwardly disposed ends of the interlocking elements 82 are respectively provided with a loop 86 that forms a gripping surface for a finger. By gripping these loops 86, the interlocking elements 82 can be moved inwardly to disengage the respective cap 80.

The radially outwardly disposed ends of the interlocking elements 82 project beyond the peripheral surface of the plate member 81, so that when the cap 80 is placed into the bell-shaped portion 3, the interlocking elements 82 engage a recessed portion formed in the interior of the bell-shaped portion 3, for example in the groove 17 or 41 of the bell-shaped portion 3 that has the rim portions 3*a*', 3*b*', 3*c*', 3*f*' and 3*g*'.

It is to be understood that when the bottle filling machine is being cleaned, all of the bell-shaped portions 3 are closed off by respective caps 80.

To ensure that after conclusion of the cleaning process, and prior to removal of the cap 80, the interior of the bell-shaped portion 3 is completely emptied of cleaning fluid, a drain valve 87 is provided on the cap 80. This valve essentially comprises a valve stem 88 that is guided through the plate member 81 in such a way that it can be shifted in an axial direction. One end of the valve stem 88 is provided with a valve disk or head 89 that via a valve spring 90 is pressed against the upper side of the plate member 81, thereby closing off two valve openings 91 that are provided in the plate member 81. When a cap 80 is secured to a bell-shaped portion 3, the valve head 89 is disposed in the interior of the closed bell-shaped portion. The other end of the valve stem 88 extends beyond the underside of the cap 80 and the bell-shaped portion 3 that is closed off therewith, so that when a bottle plate, for example the bottle plate 5*a*, 5*b*, 5*c*, 5*f* or 5*g*, is raised against the closed bell-shaped portion 3, the drain valve 87 is opened via the valve stem 88 and thus any cleaning fluid that is present in the interior of the bell-shaped portion 3 can drain via the valve openings 91. Thus, after the conclusion of the cleaning process, via at least one circulation of the bottle filling machine it is possible to ensure a complete emptying of the bell-shaped portion 3 prior to the removal of the cap 80, thereby avoiding in particular also the danger of an accident due to caustic, corrosive cleaning fluids.

The aforementioned description involved closing the bell-shaped portions 3 via the bottle plate 5*a*–5*g* and the pertaining interlocking means for various process steps during the filling of the bottles 2, whereas during the cleaning process the cap 80 was utilized for closing the bell-shaped portions 3. However, in principle it would also be possible to utilize the bottle plates 5*a*–5*g* to close off the bell-shaped portions 3 for the cleaning process. For this purpose, the lifting mechanisms for the bottle plates 5*a*–5*g* are then embodied in such a way that during the cleaning process, even with the bottle filling machine circulating, all of the bottle plates 5*a*–5*g* respectively remain in the raised position. If the lifting mechanisms have the customarily utilized lifting devices or cylinders, which are preloaded with pressurized gas in the direction for raising the bottle plates 5*a*–5*g*, and that are respectively provided with a guide roller 92 and with a control cam means 93 that cooperates therewith for lowering the bottle plates 5*a*–5*g*, then an element 94 is provided at the beginning of the contact or approach side of the control cam means 93. This element 94 can be moved out of an effective position in which it is disposed in the movement space of the guide rollers 92 and hence forms the beginning of the contact or approach side of the control cam means 93, into a non-effective position in which the element 94 is disposed beyond the path of movement of the guide rollers 92. If the element 94 is disposed in this non-effective position, then as the bottle filling machine rotates the guide rollers 92 move along their upper path and past the control cam means 93, i.e. the bottle plates 5*a*–5*g* are not lowered and the bell-shaped portions 3 remain closed for the cleaning process.

It is to be understood that for a cleaning process that utilizes the bottle plates 5*a*–5*g* for closing the bell-shaped portions 3, the so-called "formatting components", such as bottle stars, bottle guides, etc are removed or taken out of the path of the movement of the raised bottle plates 5*a*–5*g* or the pertaining lifting mechanisms 6 to the extent required.

The present invention is, of course, in no way restricted to the specific disclosure of the specification and drawings, but also encompasses any modifications within the scope of the appended claims.

What we claim is:

1. An apparatus for filling containers with a liquid material, including: at least one filling element for dispensing said liquid material into a respective container in a controlled manner; a respective bell-shaped portion for said at least one filling element, with said bell-shaped portion having a chamber for completely accommodating a respective container during a filling process, and with an underside of said bell-shaped portion having an opening for the introduction and withdrawal of a respective container; container support means; means for effecting a relative movement between said bell-shaped portion and said container support means in the direction of an axis of said at least one filling element; and closure means for closing off said opening and hence said chamber of said bell-shaped portion; said apparatus further comprising:

interlocking means provided on said bell-shaped portion as well as on said closure means such that when said chamber of said bell-shaped portion is closed off by said closure means, said bell-shaped portion and said closure means are adapted to be positively interlocked with one another at least relative to forces acting in the direction of said filling element axis.

2. An apparatus according to claim 1, in which said container support means, which forms a support surface for said containers, is disposed below said at least one filling element when viewed in the direction of said axis thereof; and in which said container support means forms said closure means, with relative movement between said bell-shaped portion and said container support means in the direction of said filling element axis effecting closing and opening of said chamber of said bell-shaped portion at said opening thereof via said container support means.

3. An apparatus according to claim 2, which, where said apparatus is used in a filling machine of rotating design, includes means for disengaging said means for effecting said relative movement between said bell-shaped portion and said container support means such that even if said machine is rotating, said container support means remains disposed in a position that closes off said opening said bell-shaped portion.

4. An apparatus according to claim 3, which includes a stationary control cam means; in which said means for effecting a relative movement between said bell-shaped portion and said container support means is provided with guide means that cooperate with said stationary control cam means; and which includes means for transferring said control cam means out of an operative position and into a non-operative position.

5. An apparatus according to claim 4, in which said means for effecting a relative movement is a lifting mechanism for said container support means, and said guide means is a guide roller on said lifting mechanism.

6. An apparatus according to claim 4, in which said control cam means, at the beginning of an approach side, is provided with an element that is movable between an operative and non-operative position.

7. An apparatus according to claim 1, which includes a cap that serves as said closure means and is manually insertable into said opening of said bell-shaped portion.

8. An apparatus according to claim 7, in which said cap is provided with a drain valve that, via an element that projects beyond an underside of said cap, is adapted to be opened for releasing at least one valve opening provided in said cap.

9. An apparatus according to claim 1, in which said interlocking means comprises: at least one movable interlocking element disposed on at least one of said container support means, said closure means, and said bell-shaped portion, with said at least one movable interlocking element being movable out of a non-interlocking position and into an interlocking position; and at least one fixed cooperating interlocking element disposed on at least one of said bell-shaped portion, said closure means, and said container support means, with said at least one fixed interlocking element having an interlocking surface means that is engaged by at least one interlocking portion of said at least one movable interlocking element in said interlocking position thereof.

10. An apparatus according to claim 9, in which said at least one interlocking portion of said at least one movable interlocking element is movable out of said non-interlocking position and into said interlocking position in a direction that is essentially radial relative to said filling element axis.

11. An apparatus according to claim 9, in which said means for effecting a relative movement between said bell-shaped portion and said container support means is a lifting mechanism for moving said container support means in a vertical direction; and in which said at least one movable interlocking element is disposed on said container support means.

12. An apparatus according to claim 11, in which movement of said at least one movable interlocking element is effected by a lifting movement of said lifting mechanism.

13. An apparatus according to claim 12, in which said container support means comprises a plate member, for closing off said chamber of said bell-shaped portion, and also comprises a head, which is associated with said lifting mechanism, with said plate member being displaceably guided on said head in the direction of said filling element axis by a prescribed amount such that upon closure of said chamber of said bell-shaped portion via said plate member, and with said plate member resting against an abutment of said bell-shaped portion, further lifting of said head effects a movement of said at least one movable interlocking element out of said non-interlocking position and into said interlocking position.

14. An apparatus according to claim 11, which includes an actuating mechanism for actuating said at least one movable interlocking element, and means for supplying pressure medium to said actuating mechanism.

15. An apparatus according to claim 14, which includes a control valve arrangement for controlling said actuating mechanism as a function of movement of said lifting mechanism.

16. An apparatus according to claim 15, in which said container support means includes a plate-like member for closing off said chamber of said bell-shaped portion, with said plate-like member being displaceably guided in the direction of said filling element axis by a prescribed amount such that upon closure of said chamber and with said plate-like member resting against said bell-shaped portion, a further lifting of said lifting mechanism for operation of said control valve arrangement is possible.

17. An apparatus according to claim 11, in which said at least one movable interlocking element is provided with control cam means for moving same between said non-interlocking and said interlocking positions thereof upon movement of said container support means past control elements that cooperate with said control cam means.

18. An apparatus according to claim 11, in which said at least one movable interlocking element is a spreadable ring having a plurality of finger or wing-like portions that extend away from a given side of an annular portion of said ring that extends around said filling element axis, whereby in said non-interlocking position said finger or wing-like portions each form an angle of less than 90° with said filling element axis and at free ends thereof are disposed at a first radial distance from said axis, with said finger or wing-like portions being resiliently deformable for increasing said angle and said first radial distance to achieve said interlocking position.

19. An apparatus according to claim 11, in which said at least one movable interlocking element is formed by a lever, one end of which is pivotably mounted about an axis that is disposed tangential to an imaginary circle that surrounds said filling element axis, with a longitudinal extension of said lever, in said non-interlocking position, forming an angle of less than 90° with said filling element axis, and with the other end of said lever, which is disposed radially outwardly relative to said filling element axis, being disposed at a radial distance from said axis, whereby said lever is movable for increasing said angle and said radial distance to achieve said interlocking position.

20. An apparatus according to claim 11, in which said at least one movable interlocking element is at least approximately radially guided in said container support means for displacement between said interlocking and said non-interlocking positions.

21. An apparatus according to claim 11, in which said at least one movable interlocking element is formed by a ring that can resiliently spread apart.

22. An apparatus according to claim 11, in which said at least one movable interlocking element is formed from at least an interlocking segment of an interlocking disk.

23. An apparatus according to claim 11, which includes overload protection means disposed between said container support means and said lifting mechanism.

24. An apparatus according to claim 9, in which said means for effecting a relative movement between said bell-shaped portion and said container support means is a lifting mechanism for moving said bell-shaped portion in a vertical direction relative to said container support means; and in which said at least one movable interlocking element is disposed on said bell-shaped portion.

25. An apparatus according to claim 9, in which a lower end of said bell-shaped portion is provided with an annular rim portion that when said chamber is closed off surrounds one of said container support means and said closure means, with said at least one fixed interlocking element being provided on said annular rim portion.

26. An apparatus according to claim 25, in which said at least one fixed interlocking element of said annular rim portion of said bell-shaped portion is a groove.

27. An apparatus according to claim 25, in which said at least one fixed interlocking element of said annular rim portion of said bell-shaped portion is at least a shoulder.

28. An apparatus according to claim 1, which includes sealing means provided on one of said bell-shaped portion and said container support means to effect a tight sealing of said chamber, with at least a portion of said sealing means having a V-shaped cross-sectional configuration formed by two sealing lips, with the recess means formed between said sealing lips, when said chamber is closed off, facing a part of the region that is to be sealed between said bell-shaped portion and said container support means that leads to said chamber.

29. An apparatus according to claim 1, which includes sealing means provided on one of said bell-shaped portion and said container support means, whereby when said chamber of said bell-shaped portion is closed, said sealing means rests against a sealing surface of the other of said container support means and said bell-shaped portion, with said sealing surface being essentially disposed in a plane that extends perpendicular to said filing element axis.

30. An apparatus according to claim 29, in which said sealing surface is provided on said container support means and is recessed relative to a container support surface thereof.

31. An apparatus according to claim 30, which includes glide plate means for covering said sealing surface at at least one of a container inlet and a container outlet of a container filling machine.

32. An apparatus according to claim 1, in which said container support means is provided with an exchangeable plate that forms a container support surface.

* * * * *

UNITED STATES PATENT AND TRADEMARK OFFICE

CERTIFICATE OF CORRECTION

PATENT NO. : 5,167,266

DATED : December 1, 1992

INVENTOR(S) : Egbert Diehl et al

It is certified that error appears in the above-identified patent and that said Letters Patent is hereby corrected as shown below:

On the title page, please change:

[22] Filed: Apr. 26, 1991

Signed and Sealed this

Twelfth Day of October, 1993

*Attest:*

*Attesting Officer*

BRUCE LEHMAN

*Commissioner of Patents and Trademarks*